US005162777A

United States Patent [19]

Kolbatz

[11] Patent Number: 5,162,777

[45] Date of Patent: Nov. 10, 1992

[54] SUBMERGED ALARM DEVICE FOR MONITORING SWIMMING POOLS

[76] Inventor: Klaus-Peter Kolbatz, Langenauer Weg 21, 1000 Berlin 27, Fed. Rep. of Germany

[21] Appl. No.: 630,979

[22] Filed: Dec. 21, 1990

[51] Int. Cl.[5] ..... G08B 13/00

[52] U.S. Cl. ..... 340/566; 340/573; 367/136; 367/188; 367/151

[58] Field of Search ..... 340/566, 573; 381/156, 381/169, 205; 181/177; 367/151, 188, 136

[56] References Cited

U.S. PATENT DOCUMENTS 2,761,117 8/1956 Green ..... 367/151
3,482,237 12/1969 Hamburg ..... 340/566
4,348,750 9/1982 Schwind ..... 367/151

*Primary Examiner*—Jin F. Ng
*Assistant Examiner*—Christine K. Oda
*Attorney, Agent, or Firm*—Millen, White & Zelano

[57] ABSTRACT

An alarm device is placed in the water of a swimming pool for monitoring the swimming pool by triggering an alarm in response to changes in water pressure or sound as a result of persons falling into the swimming pool. The device includes a switch element and wave detector, as well as an acoustic alarm. A covering device or shelf, placed below the water surface and above the detector device is an integral component of the alarm device. The covering device includes a parabolically designed wall which is placed around the detector and is in hydraulic connection with it.

8 Claims, 4 Drawing Sheets

SUBMERGED ALARM DEVICE FOR MONITORING SWIMMING POOLS

BACKGROUND OF THE INVENTION

The invention relates to a submerged alarm for monitoring swimming pools.

In alarm triggering devices used in swimming pools, it is current practice to project a portion of the devices into swimming pools to detect wave movements which trigger an alarm to emit an audible signal. Such a device is known, for example, in U.S. Pat. No. 4,510,487, where a submerged pipe includes a chamber in which a float, provided with a magnet, is placed. If sizable objects fall into the water, the water movements cause an up and down movement of the submerged pipe, which presses the float with the magnet against electric contacts and electrically connects an alarm device. In this case using the submerged pipe as an alarm triggering device, like all usual alarm triggering devices, during the swimming operation is placed so as to be freely accessible and unprotected. This is obviously a drawback. On the one hand, this is a drawback for swimmers themselves, who can get caught in the alarm triggering device placed unprotected in the swimming pool, and thus annoyed while swimming. On the other hand, childless swimming pool owners will refrain from installing an alarm triggering device since no small children are in danger. Unfortunately, the latter attitude is inappropriate since small children in the neighborhood can easily obtain access to a swimming pool so that an alarm triggering device is advisable where the owner has no small children.

SUMMARY OF THE INVENTION

An object of the invention is to eliminate the above-mentioned drawbacks in an alarm trigger device of the initially mentioned type and to provide an alarm triggering device which can be placed in a protected manner in a swimming pool and in case of an emergency provide reliable performance.

This object is achieved by providing an alarm comprising as an internal component a covering device positioned below the water surface and above detection device wherein the covering device includes a parabolically formed wall surface which is placed around detection device in working connection with the latter.

The advantages achieved with the invention consist especially in that with simple means an alarm device in a swimming pool can also be retrofitted with a protective covering device. Furthermore, by suitably shaping the covering device, the effectiveness of the wave movements around the alarm device triggering the alarm are amplified.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
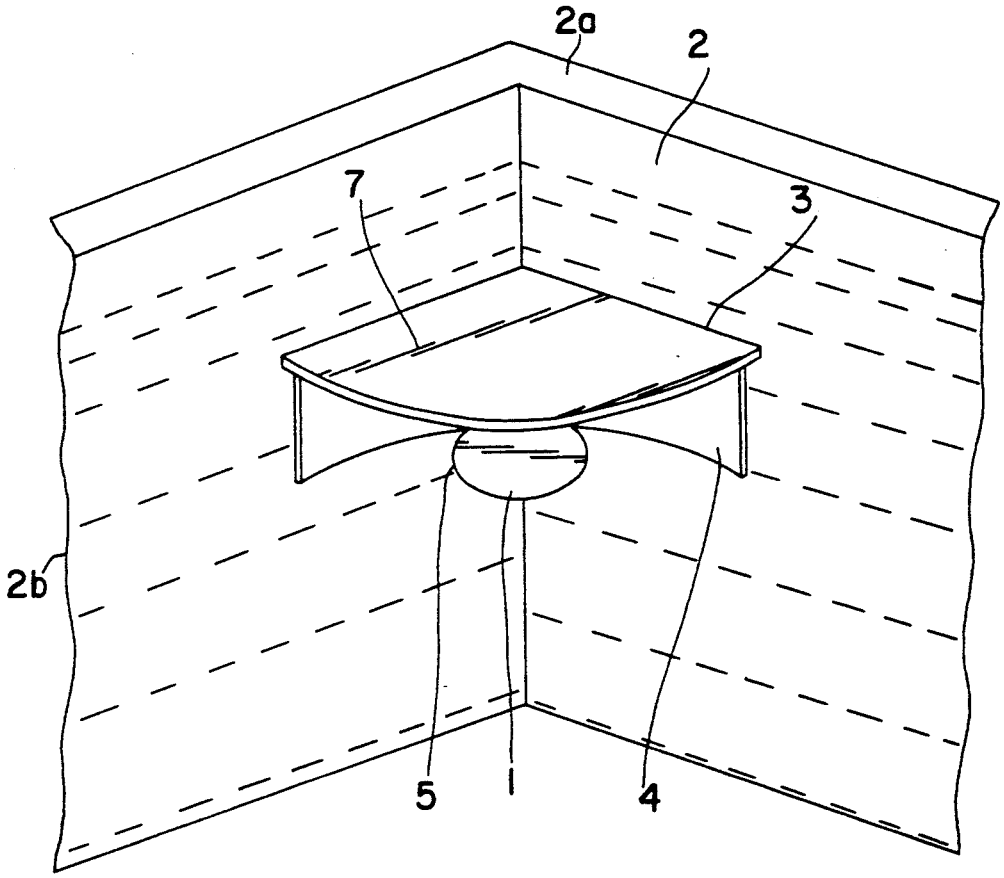
FIG. 1 is a perspective view of an alarm device, placed in a swimming pool, with a covering device according to the invention.

As can be seen in FIG. 1, an alarm device 1 is placed in the corner of swimming pool 2 under the water surface and is surrounded by a covering device 3. Covering device 3 has a parabolically configured wall surface 4, which in combination with the shelf forms a covered housing facing away from the wall of the swimming pool 2. The housing is placed around detection device 5 detecting the wave movements.

Figure 2:
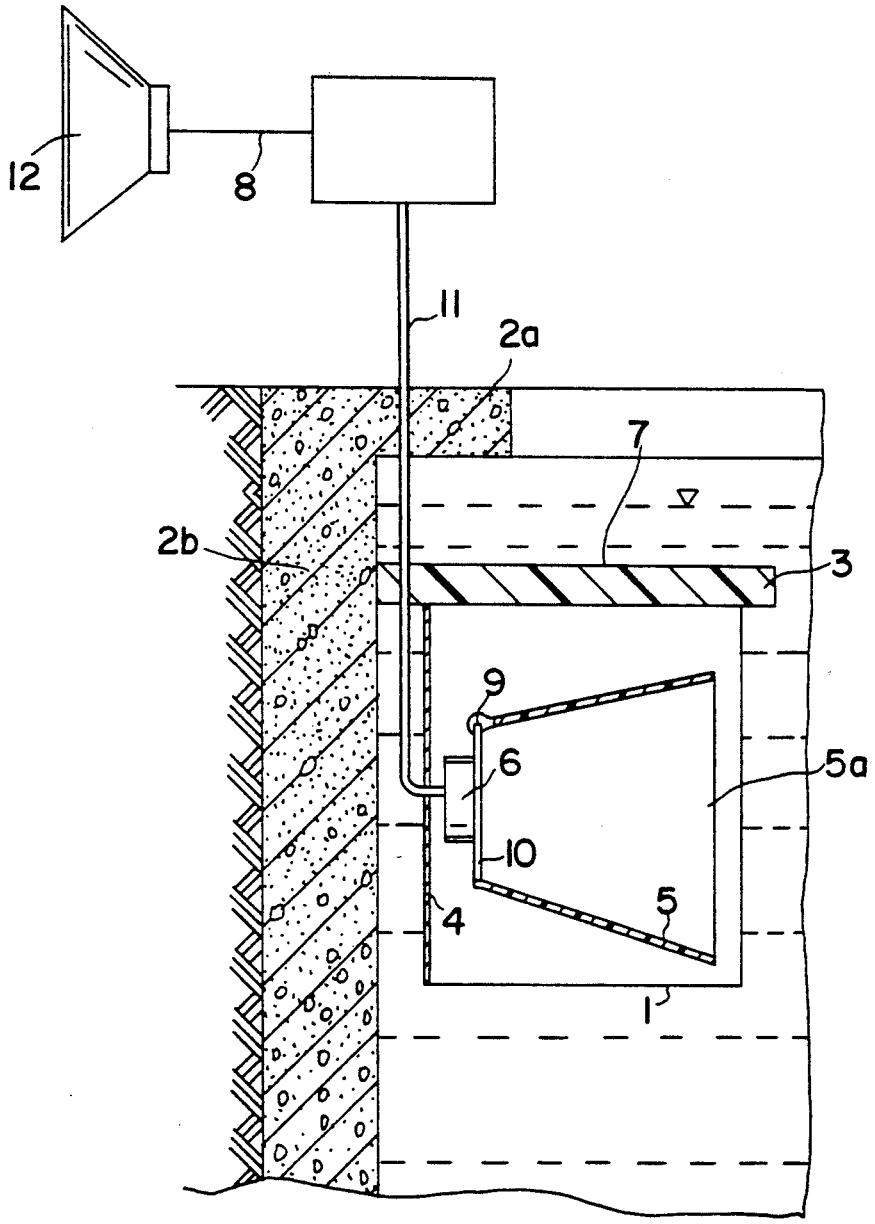
FIG. 2 is a side view in cross-section representing a first embodiment of the invention.

Detection device 5 is advantageously designed as a funnel-shaped enclosure, which has a funnel opening **5*a* which receives and amplifies wave movements in proximity to the alarm device 1 and which strike an alarm segment, i.e., an alarm switch 6 (FIG. 2). By such amplification, a greater range for alarm device 1 is advantageously achieved and the response sensitivity is increased. To achieve a desirable partitioning of alarm device 1 from false alarm reports, preferably it, together with covering device 3, is placed up to 20 cm below the water level. In this case, covering device 3 can be designed as a seat 7, which for swimming pool users has the advantage that they do not have to sit on the swimming pool edge 2*a* heated by sun radiation. Seat 7 to be mounted below the water surface can already be incorporated in swimming pool wall 2*b*** both in the finished swimming pool and in the production of the rough shell. It can also be retrofitted.

In addition, the covering device 3 with detection device 5 can advantageously be inserted in swimming pool wall **2*b*, and alarm device 1 can be incorporated flush in swimming pool wall 2*b*. Covering device 3 can also be designed as a ladder for swimming pool users getting in and out of the pool with the alarm device 1** placed, protected, respectively between the ladder rungs.

The cable duct (not shown in the drawing) receiving the electric cables for supplying alarm device 1 can advantageously be designed as a feed pipe or as a pressure compensating pipe.

An alarm device 1, placed on swimming pool edge **2*a* or in a corner of the swimming pool, with an acoustic alarm 8 and covering device 3, preferably designed as seat 7, is illustrated in FIG. 2. Parabolic wall surface 4 is placed below seat 7 and surround funnel-shaped housing 5 on its rear side, so that funnel opening 5*a* is freely accessible for detecting wave movements, triggering the alarm by alarm switch 6. The parabolic wall surface 4 extends substantially perpendicular to the shelf 7. Alarm switch 6 is encapsulated and watertight and is placed on the rear side of a flap 10 mounted to rotate on a horizontal shaft 9 in an arc within a plane perpendicular to the plane of the water surface at the output of funnel-shaped housing 5**.

Switch element 6 is preferably a mercury switch but can be a microphone, a hydrophone or other suitable sensor. The wave movement, caused by a body falling into swimming pool 2, is received, amplified, by funnel-shaped housing 5 in combination with parabolic edge 4 of covering device 3 and imparts to the flap 10 a rotating movement, as a result of which alarm switch 6 connected to acoustic alarm 8 by cable 11 turns on alarm circuit 8. This causes a signal horn 12 to emit an acoustic alarm. Funnel-shaped housing 5, placed under the water surface in swimming pool 2, is fastened to an angular rod, which, with its angular part, is place on swimming pool edge 2*a*.

Figure 4:
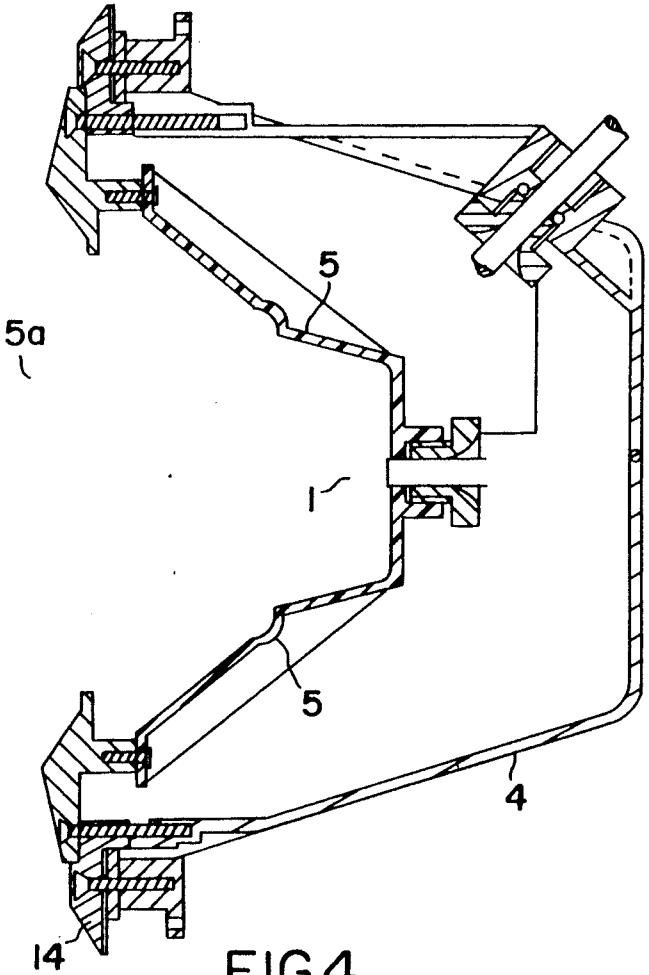
FIG. 4 is a cross sectioned view taken along lines 4—4 of FIG. 3.
Figure 3:
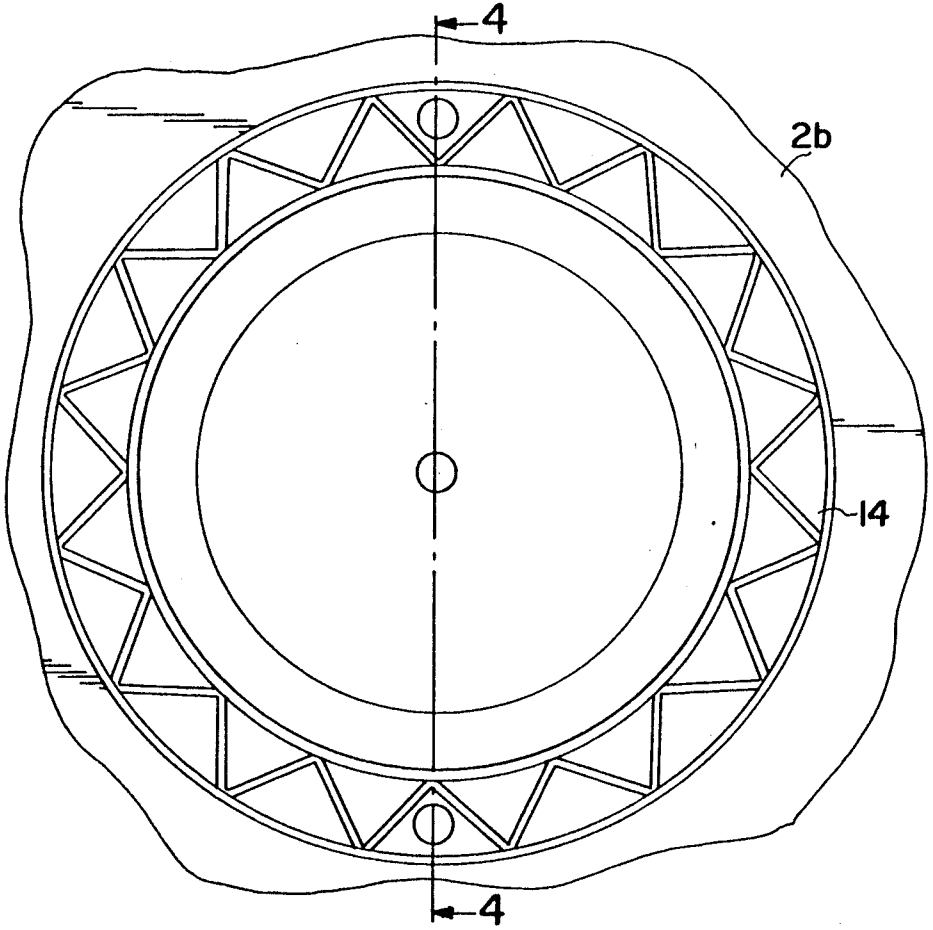
FIG. 3 is a front view of a second embodiment of the invention wherein the alarm device is positioned within a swimming pool wall.

FIGS. 3 and 4 show an arrangement for mounting an alarm device 1 within the wall 2*b* of the swimming pool 2 (FIG. 1) wherein a flange 14 retains the alarm device in a matter so that the structure thereof does not protrude into the pool.

Figure 5:
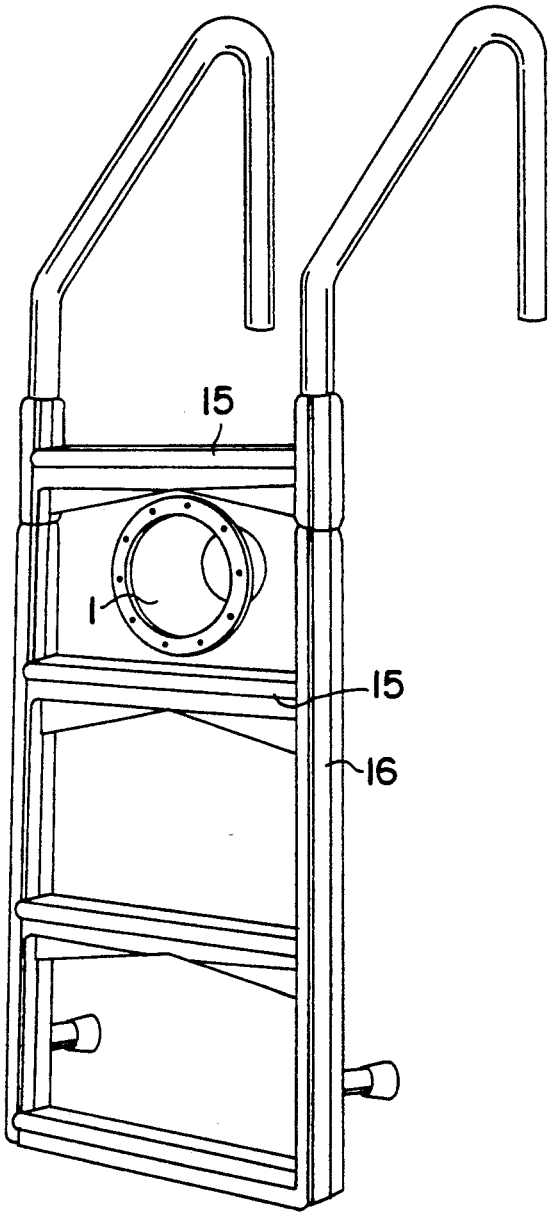
FIG. 5 is a perspective view of the alarm device of FIG. 2 incorporated in a swimming pool ladder.

FIG. 5 illustrates an alarm device 1 disposed between the rungs 15 of a ladder 16.

| | List of Reference Numbers |
|---|---|
| Alarm device | 1 |
| Swimming pool | 2 |
| Swimming pool edge | 2a |
| Swimming pool wall | 2b |
| Covering device | 3 |
| Parabolic wall surface | 4 |
| Detection device | 5 |
| Funnel opening | 5a |
| Alarm switch | 6 |
| Seat | 7 |
| Acoustic alarm | 8 |
| Shaft | 9 |
| Flap | 10 |
| Cable connection | 11 |
| Signal horn | 12 |
| Rod | 13 |
| Flange | 14 |
| Rungs | 15 |
| Ladder | 16 |

The entire disclosures of all applications, patents and publications, if any, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In combination with a swimming pool filled with water wherein the surface of the water is at a predetermine level with respect to a selected level on a wall of the swimming pool;

a shelf positioned adjacent the wall of the pool at a level beneath the surface of the water and extending parallel with respect to the surface of the water, the shelf having a wall extending downwardly therefrom and the wall having a parabolic surface extending substantially perpendicular to the shelf defining with the shelf a partial enclosure having an opening facing away from the wall;

a detector device positioned within the partial enclosure for detecting disturbance within the water; and an alarm connected to the detector for emitting a signal upon the detector detecting a disturbance whereby notification is provided that a person has entered the pool.

2. The combination of claim 1, wherein the shelf is placed at lest 20 cm beneath the surface of the water to minimize false alarm reports.

3. The combination of claim 1, wherein the detection device includes a frustoconical shaped housing with a transducer pivoted herein, the alarm being connected to the transducer.

4. The combination of claim 3, wherein the shelf is configured as a seat fixed to the wall of the swimming pool.

5. The combination of claim 3, wherein the shelf is configured as a step of a ladder mounted in the swimming pool with the detector mounted beneath the step.

6. The combination of claim 3, wherein the shelf is built into the wall of the swimming pool.

7. The combination of claim 7, wherein the shelf projects from the wall.

8. The combination of claim 7, wherein the shelf projects back into the wall and wherein the detection device is positioned within the wall of the pool.

* * * * *